United States Patent [19]

Miles et al.

[11] Patent Number: 4,578,159

[45] Date of Patent: Mar. 25, 1986

[54] ELECTROLYSIS OF ALKALI METAL CHLORIDE BRINE IN CATHOLYTELESS MEMBRANE CELLS EMPLOYING AN OXYGEN CONSUMING CATHODE

[75] Inventors: Ronald C. Miles; David D. Justice, both of Cleveland, Tenn.; Ronald L. Dotson, Cheshire, Conn.

[73] Assignee: Olin Corporation, Cheshire, Conn.

[21] Appl. No.: 727,171

[22] Filed: Apr. 25, 1985

[51] Int. Cl.[4] ..... C25B 1/16

[52] U.S. Cl. ..... 204/98

[58] Field of Search ..... 204/98, 128

[56] References Cited

U.S. PATENT DOCUMENTS

| | | | |
|---|---|---|---|
| 4,035,254 | 7/1977 | Gritzner | 204/98 |
| 4,221,644 | 9/1980 | LaBarre | 204/98 |
| 4,224,129 | 9/1980 | McIntyre et al. | 204/263 |
| 4,244,793 | 1/1981 | Johnson et al. | 204/98 |
| 4,312,720 | 1/1982 | Lefevre | 204/98 |
| 4,332,662 | 6/1982 | Pouli et al. | 204/295 |
| 4,341,606 | 7/1982 | McIntyre et al. | 204/98 |
| 4,376,691 | 4/1983 | Lindstrom | 204/265 |
| 4,406,758 | 9/1983 | McIntyre et al. | 204/98 |
| 4,430,177 | 2/1984 | McIntyre et al. | 204/98 |
| 4,445,986 | 5/1984 | McIntyre et al. | 204/98 |
| 4,486,276 | 12/1984 | Cohn et al. | 204/98 |
| 4,511,441 | 4/1985 | McIntyre et al. | 204/98 |

*Primary Examiner*—John F. Niebling

*Assistant Examiner*—Terryence Chapman

*Attorney, Agent, or Firm*—James B. Haglind; Donald F. Clements

[57] ABSTRACT

A process for the electrolysis of an aqueous solution of an alkali metal halide in an electrolytic cell having an anode compartment containing at least one anode, a cathode compartment containing at least one cathode, and a cation exchange membrane separating the anode compartment from the cathode compartment comprises feeding the aqueous solution of an alkali metal halide to the anode compartment; feeding an oxygen-containing gas to the cathode compartment; and electrolyzing the alkali metal halide solution to produce a halogen gas and alkali metal ions in the anode compartment. The alkali metal ions and water are passed through the cation exchange membrane into the cathode compartment to contact a hydrophilic porous cathode. The alkali metal ions, the water and the oxygen-containing gas produce a concentrated alkali metal hydroxide solution which flows through a hydrophilic porous cathode. The concentrated alkali metal hydroxide solution is removed from the cathode compartment to prevent a substantial accumulation of the concentrated alkali metal hydroxide solution in the cathode compartment.

The process of the present invention provides operation of the membrane all independently of oxygen gas and liquid diffusion rates to permit high current densities to be employed.

11 Claims, No Drawings

ELECTROLYSIS OF ALKALI METAL CHLORIDE BRINE IN CATHOLYTELESS MEMBRANE CELLS EMPLOYING AN OXYGEN CONSUMING CATHODE

This invention relates to electrolytic cells for the production of chlorine and alkali metal hydroxides. More specifically, the invention relates to electrolytic cells for the production of chlorine and alkali metal hydroxides employing an oxygen-containing gas in the cathode compartment.

In theory, the use of oxygen consuming cathodes in place of hydrogen cathodes in chlor/alkali electrolysis should significantly reduce the energy consumption required. For example, Schmid and Medic point out in "Investigation of Oxygen-Consuming Cathodes for Use in Chlor/Alkali Electrolysis", Dechema Monograph, 92, 1982, pp. 335–347, that fundamentally the oxygen consuming cathode could save up to a maximum of 1.23 volts vs. the hydrogen evolving cathode. Fundamental and practical problems have, however, until now, prevented the commercialization of oxygen consuming electrodes.

There are two traditional methods for operating electrolytic cells employing oxygen-consuming cathodes. The first method is to completely immerse the cathode in the caustic liquor, spaced apart from the separator used. Since the solubility of oxygen in caustic is very low, the rate at which oxygen can reach the cathode is low. Therefore, the current densities employed in the operation of these cells have to be low, usually below 1 $KA/m^2$. Further, because of the large amounts of water in the catholyte, the probability of the very undesirable and dangerous reaction evolving hydrogen is high.

In the second traditional method, the oxygen consuming cathode is again spaced away from the separator with caustic liquor between the separator and the cathode. On the back side of the cathode, oxygen, air, or oxygen-enriched air is supplied in a gas filled chamber. The oxygen-consuming reaction depends upon oxygen diffusing from the gas side of the cathode and water diffusing from the liquid side of the cathode under very exact hydrostatic conditions. The cathode does not permit liquid flow through it. For the complicated reactions to occur properly, the hydrostatic pressure and the gas pressure need to be in balance and as the hydrostatic pressure is not constant over the surface of the electrode, the pore sizes of the cathode need to vary accordingly. This balancing problem is a real constraint on the structure of the electrodes and the operating efficiency of the cells.

More recently, oxygen-consuming cathodes have been employed which permit some flow of liquid through the cathode. U.S. Pat. No. 4,376,691, issued Mar. 15, 1983 to O. Lindstrom, teaches an oxygen consuming cathode having a hydrophobic side in which holes can be made in up to about 10% of the surface area to permit the electrolyte to flow through the cathode.

In U.S. Pat. No. 4,332,662, issued June 1, 1982 to D. Pouli et al, a conventional hydrophobic cathode having a catalyst bonded with polytetrafluoroethylene has openings which provide an open area of 2 to 80%. The openings are holes or regions of greater hydrophilicity which permit the liquid product to flow through. Both of these patents thus require hydrophobic cathodes which are subsequently modified.

There is a need, therefore, for an electrolytic cell using oxygen consuming cathodes whose operation overcomes the difficulties and disadvantages of the methods of the prior art.

It is an object of the present invention to provide a process for operating an electrolytic cell which is independent of oxygen gas and liquid diffusion rates.

Another object of the present invention is to provide a process for operating an oxygen-consuming electrolytic cell in which the hydrostatic pressure is minimized over the entire cathode area.

An additional object of the present invention is to provide a process for operating an oxygen-consuming electrolytic cell which produces concentrated solutions of alkali metal hydroxides.

A further object of the present invention is to provide a process for operating electrolytic cells using oxygen-consuming cathodes which results in low voltages while employing high current densities.

A still further object of the present invention is to provide a process for operating electrolytic cells using oxygen-consuming cathodes in the absence of a substantial accumulation of catholyte liquor in the cathode compartment.

These and other objects of the present invention are accomplished in a process for the electrolysis of an aqueous solution of an alkali metal halide in an electrolytic cell having an anode compartment containing at least one anode, a cathode compartment containing at least one cathode, and a cation exchange membrane separating the anode compartment from the cathode compartment, the process which comprises:

(a) feeding the aqueous solution of an alkali metal halide to the anode compartment;

(b) feeding an oxygen-containing gas to the cathode compartment;

(c) electrolyzing the alkali metal halide solution to produce a halogen gas and alkali metal ions in the anode compartment;

(d) passing the alkali metal ions and water through the cation exchange membrane into the cathode compartment;

(e) contacting a hydrophilic porous cathode with the alkali metal ions, the water and the oxygen-containing gas to produce a concentrated alkali metal hydroxide solution, the concentrated alkali metal hydroxide solution flowing through the hydrophilic porous cathode; and (f) removing the concentrated alkali metal hydroxide solution from the cathode compartment to prevent a substantial accumulation of the concentrated alkali metal hydroxide solution in the cathode compartment.

The novel process of the present invention electrolyzes aqueous alkali metal halide solutions such as alkali metal chlorides or bromides, over a wide range of current densities. For example, in the electrolysis of alkali metal chloride brines such as sodium chloride, where the NaCl concentration is from about 150 to about 300 grams per liter, and preferably from about 170 to 220 grams per liter, current densities of at least about 2, for example from about 2 to about 8 kiloamperes per square meter of membrane surface area may be employed. Preferred current densities are those in the range of from about 2.5 to about 5 kiloamperes per square meter, with the more preferred range being from about 3 to about 4 kiloamperes per square meter. Current densities above about 8 may be employed if desired. During cell operation, the anode compartment and the cathode compartment are maintained at substantially the same temperatures, for example, temperatures in the range of from about 60° to about 95° C.

In the anode compartment, halogen gases such as chlorine or bromine are produced as well as alkali metal cations such as sodium or potassium. During cell operation, the alkali metal cations and water are transported from the anode compartment through the cation exchange membrane to the cathode compartment.

The production of the concentrated alkali metal hydroxide solution (catholyte liquor) in the cathode compartment is the result of the combination of hydroxide ions, formed by decomposition of the water which is transported through the membrane or added to the cathode compartment, with the alkali metal ions. The immediate and continuous removal of the catholyte liquor as it is produced enables the cell to be operated substantially catholyteless and without the cathode or the membrane on the cathode side being immersed in a substantial body of catholyte liquor. This continual draining of the alkali metal hydroxide solution permits the cell to be operated to produce maximum concentrations of alkali metal hydroxide for the cation exchange membrane and the current density employed, as there is no additional dilution of the catholyte liquor in the cathode compartment. The amount of catholyte liquor remaining in the cathode compartment during operation of the cell is less than about 30 percent by volume. Preferably the level of concentrated alkali metal hydroxide in the cell during operation is maintained below the active electrode area of the cathode, that is the area of the cathode at which electrolysis takes place. The cathode is therefore exposed to a gaseous atmosphere over at least 70 percent, preferably 80 to 100 percent, and more preferably 90 to 100 percent of its active electrode area; that is, not more than 30 percent of the active electrode area is immersed in the concentrated catholyte liquor.

During the operation of the cell, the addition of water or a caustic solution to the cathode compartment generally is not required and preferably the only water added to the cathode compartment is that which is transferred through the membrane. To prevent damage such as blistering to the membrane during the cell start-up period, it may be necessary to condition the membranes. This can be accomplished by one of several methods. For example, the cathode chamber can initially be filled with an alkali metal hydroxide solution to wet the cathode, the cathode-membrane contact area, and the cathode side of the membrane, while flushing gases such as nitrogen from the compartment. The catholyte is then drained from the cathode compartment and simultaneously an oxygen containing gas is fed to fill the cathode compartment. In another embodiment, during the initial start-up period, the cell may be operated at low current densities, for example, those below about 1 kiloampere per square meter. During the start-up period, the current density is gradually increased until the cell is operating at the desired current density.

In a preferred embodiment where the only source of liquid to the cathode compartment is by transfer through the cation exchange membrane, the concentration of the catholyte liquor produced is directly related to the rate at which water is transported through the membrane during cell operations. In membrane cells, this rate is known as the water transport number. Suitable membranes employed in the novel process of the present invention have water transport numbers (WTN) in the range of from about 2 to about 7. These water transport numbers are related to the desired concentration of the alkali metal hydroxide solution and the current efficiencies achieved. For example, where a solution of sodium hydroxide containing 50% or greater by weight of NaOH is being produced, a membrane having a water transport number of at least 2, for example from about 2.3 to about 2.6 is required at operating current efficiencies in the range of about 80% to about 95%. Similarly, at membrane water transport numbers in the range of from about 5.8 to about 6.8, a sodium hydroxide solution containing about 25% by weight of NaOH is produced.

Cation exchange membranes, which can be employed as the separator in the process of the present invention, are inert, flexible membranes, which are substantially impervious to the hydrodynamic flow of the electrolyte and the passage of gas products produced in the cell. Suitably used, for example, are those comprised of fluorocarbon polymers having a plurality of pendant sulfonic acid groups or carboxylic acid groups or mixtures of sulfonic acid groups and carboxylic acid groups. The terms "sulfonic acid group" and "carboxylic acid group" are meant to include salts of sulfonic acid or salts of carboxylic acid which are suitably converted to or from the acid groups by processes such as hydrolysis. Suitable cation exchange membranes are sold commercially by E. I. DuPont de Nemours and Company under the trademark "Nafion"; by the Asahi Glass Company under the trademark "Flemion"; and by the Asahi Chemical Co. under the trademark "Aciplex".

The cation exchange membrane may be positioned, for example, vertically or horizontally to separate the anode compartment from the cathode compartment, with preference being given to vertical positioning. The cathode is placed in contact with the membrane and the anode may also be placed in contact with the membrane, if desired, to reduce power consumption.

Suitable hydrophilic cathodes employed in the electrolytic cell of the present invention include those having at least one catalytically active material including, for example, porous materials such as those of a Raney metal (e.g. silver), porous graphite, platinum or a platinum group metal, or permeable catalytic electrodes such as those having cathode catalyst materials attached to or embedded in the membrane. The cathodes which can be employed permit the flow of water through the cathode, for example, at a rate of at least 5 milligrams per square centimeter per minute, and preferably at from about 10 to about 20 milligrams per square centimeter per minute. This rate is determined by collecting, for a given period of time, the alkali metal hydroxide product and determining the product weight and its concentration of alkali metal hydroxide in percent by weight. The weight of alkali metal hydroxide is calculated and subtracted from the total product weight. The weight of water obtained is then divided by the collection time.

One preferred cathode embodiment comprises an air (or oxygen) depolarized cathode which is hydrophilic and stable in concentrated alkali metal hydroxide solutions. The cathode has a low load of platinum or a platinum group metal and may include as an electrode support a conductive metal screen such as that of nickel or cobalt which may have deposited thereon a matrix of a material such as graphite having a catalyst such as silver or a platinum group metal embedded therein.

Other suitable cathodes include highly porous reticulate cathodes comprised of electroconductive filaments and having a means of applying an electrical potential to the filaments. The filaments may be those of the electroconductive metals themselves, for example, nickel, titanium, platinum, or steel, or of materials which can be coated with an electroconductive metal. Materials which can be coated with these electroconductive metals include, for example, metals such as silver, titanium, or copper; plastics such as polyarylene sulfides, polyolefins produced from olefins having 2 to about 6 carbon atoms and their chloro- and fluoro-derivatives, nylon, melamine resins, acrylonitrile-butadiene-styrene (ABS) copolymers, and mixtures thereof.

Where the filaments are nonconductive to electricity, it may be necessary to sensitize the filaments by applying a metal such as silver, nickel, aluminum, palladium or their alloys by known procedures. The electroconductive metals are then deposited on the sensitized filaments.

Suitable reticulate electrodes and methods for their fabrication are described in U.S. Pat. No. 4,370,214, issued Jan. 25, 1983, to I. V. Kadija which is incorporated herein in its entirety by reference.

Hydrophilic cathodes employed in the process of the present invention permit liquid flow through the cathode over the entire active electrode area. This free flow of liquid through the cathode substantially prevents the build up of hydrostatic pressure across the cathode.

The oxygen-containing gas supplied to the cathode compartment may be oxygen, air, and mixtures thereof. When a gas containing air is used, it is advisable to remove $CO_2$ contained therein, by known means such as scrubbing in a caustic solution, prior to feeding the gas to the cathode compartment.

Any commercially available anodes for use in, for example, chlor-alkali electrolytic cells may be employed in the electrolytic cell and process of the present invention. These include anodes of graphite or a foraminous valve metal such as titanium or tantalum having an electrochemically active coating over at least a portion of the anode surface. Suitable coatings include those of a platinum group metal, platinum group metal oxide, an alloy of a platinum group metal or mixtures thereof. The term "platinum group metal" means an element of the group consisting of ruthenium, rhodium, platinum, palladium, osmium and irridium. Coatings containing mixtures of valve metal oxides such as titanium oxides and platinum group metal oxides such as ruthenium oxide are described in U.S. Pat. No. 3,632,498 issued to H. B. Beer on Jan. 4, 1972. Other anodes which may be employed include those described in U.S. Pat. Nos. 4,333,805, issued June 8, 1982, to C. R. Davidson et al; 4,240,887, issued Dec. 23, 1980, to D. E. Hall; 4,200,515, issued Apr. 29, 1980, to D. E. Hall et al; 4,042,484, issued Aug. 16, 1977, to G. Thiele et al; 3,962,068, issued June 8, 1976, to D. Zoellner et al; and 3,992,280, issued Nov. 16, 1976, to D. Zoellner et al.

By employing the novel process of the present invention, it is possible to reduce the cell voltage substantially; to reduce the volume of the cathode compartment; eliminate liquid addition to the cathode compartment; eliminate catholyte gas disengaging means; and eliminate recirculation means such as downcomers and upcomers from the cathode compartment. These reductions and eliminations substantially reduce the material and capital costs of an electrolytic membrane cell while permitting an increase in productivity per unit area of floor space.

Operation of the process of the present invention is free of the requirements for balancing the hydrostatic pressures and gas pressures in the cathode compartment and permits the use of increased current densities.

The novel electrolytic process of the present invention produces catholyte liquor which is at the maximum concentration permitted by the membranes employed. For example, where the catholyte liquor is sodium hydroxide, the catholyte concentration is at least about 25 percent, and preferably from about 30 to about 50 percent by weight of NaOH.

The novel process of the present invention is illustrated by the following EXAMPLES without any intention of being limited thereby.

EXAMPLE 1

An electrolytic cell having an ACIPLEX ®F(532) cation exchange membrane (WTN=4.0) vertically separating the anode compartment from the cathode compartment was constructed. The cell employed as the anode a porous titanium mesh having a mixture of ruthenium oxide and titanium oxide as the electrochemically active coating. The anode was spaced apart from the cathode. An electrolyte porous hydrophilic low platinum loaded (0.50 mg/cm$^2$±10%) air cathode was employed as the cathode. The cathode was placed in contact with the membrane. Sodium chloride brine was continuously fed to the anode compartment to provide an anolyte having a NaCl concentration of 196 grams per liter with the depleted anolyte being continuously removed from the anode compartment. Prior to cell startup, the cathode compartment was filled with 35% NaOH. The caustic solution was drained from the cathode compartment and oxygen gas fed into the cathode compartment. Electric current at a current density of 3 kiloamps per square meter was passed through the cell. Chlorine gas was produced at the anode. The NaOH solution, at an average concentration of 33.8 percent, was removed from the bottom of the cell at a rate which prevented an accumulation of caustic product in the cathode compartment. The rate of water which flowed through the cathode was determined to be 13 milligrams per square centimeter per minute. The cell was operated for a period of 10 days at an average cell voltage of 2.16 volts, a current efficiency of 94.9% and a power consumption of 1525 kilowatt hours per metric ton of NaOH.

EXAMPLE 2

An electrolytic cell was constructed having as the cation exchange membrane ACIPLEX ®F(582) (WTN=4.2) positioned horizontally in the cell. The anode and cathode employed were identical to those used in Example 1 and both contacted the cation exchange membrane. Sodium chloride brine was fed to and removed from the anode compartment to maintain the anolyte concentration at 208 grams per liter of NaCl. Current was passed at a current density of 3.0 kA/m$^2$ to continuously produce chlorine gas and an alkali metal hydroxide solution having an average concentration 35.9% by weight of NaOH. During the 2 days of cell operation, the cell voltage averaged 2.07 volts with the current efficiency averaging 94.0%, and a power consumption of 1476 kilowatt hours per metric ton of NaOH.

What is claimed is:

1. A process for electrolysis of an aqueous solution of an alkali metal halide in an electrolytic cell having an anode compartment containing at least one anode, a cathode compartment containing at least one cathode, and a cation exchange membrane separating said anode compartment from said cathode compartment, said process which comprises:

(a) feeding said aqueous solution of an alkali metal halide to said anode compartment;

(b) feeding an oxygen-containing gas to said cathode compartment;

(c) electrolyzing said alkali metal halide solution at a current density of at least about 2 kiloamperes per square meter to produce a halogen gas and alkali metal ions in said anode compartment;

(d) passing said alkali metal ions and water through said cation exchange membrane into said cathode compartment;

(e) contacting a hydrophilic porous cathode with said alkali metal ions, said water and said oxygen-containing gas to produce a concentrated alkali metal hydroxide solution, said concentrated alkali metal hydroxide solution flowing through said hydrophilic porous cathode at a rate of from about 10 to about 20 milligrams per square meter per minute; and (f) removing said concentrated alkali metal hydroxide solution from said cathode compartment to prevent a substantial accumulation of said concentrated alkali metal hydroxide solution in said cathode compartment.

2. The process of claim 1 in which said alkali metal halide is an alkali metal chloride or an alkali metal bromide.

3. The process of claim 2 in which said alkali metal halide is an alkali metal chloride.

4. The process of claim 3 in which said concentrated alkali metal hydroxide solution is sodium hydroxide having a concentration of at least about 25% by weight of NaOH.

5. The process of claim 4 in which said oxygen-containing gas is selected from the group consisting of oxygen, air, and mixtures thereof.

6. The process of claim 5 in which said electrolysis is conducted at a current density of from about 2 to about 8 kiloamperes per square meter of membrane surface.

7. The process of claim 2 in which at least 70 percent of the active electrode area of said hydrophilic porous cathode is not immersed in said concentrated alkali metal hydroxide solution.

8. The process of claim 7 in which said cation exchange membrane contacts said hydrophilic porous cathode.

9. The process of claim 8 in which said cation exchange membrane is positioned vertically between said anode compartment and said cathode compartment.

10. The process of claim 9 in which said cation exchange membrane is positioned horizontally between said anode compartment and said cathode compartment.

11. The process of claim 8 in which said concentrated alkali metal hydroxide solution is maintained at a level below the active electrode areas of said hydrophilic porous cathode.

* * * * *